US007091480B2

(12) United States Patent
Yamaguchi et al.

(10) Patent No.: US 7,091,480 B2
(45) Date of Patent: Aug. 15, 2006

(54) METHOD OF DETERMINING MASS-TO-CHARGE RATIO OF IONS AND MASS SPECTROMETER USING THE METHOD

(75) Inventors: Shinichi Yamaguchi, Kyouto-fu (JP); Morio Ishihara, Osaka-fu (JP); Michisato Toyoda, Osaka-fu (JP)

(73) Assignees: Shimadzu Corporation, Kyoto (JP); Osaka University, Suita (JP)

( * ) Notice: Subject to any disclaimer, the term of this patent is extended or adjusted under 35 U.S.C. 154(b) by 120 days.

(21) Appl. No.: 10/959,433

(22) Filed: Oct. 7, 2004

(65) Prior Publication Data

US 2005/0077462 A1 Apr. 14, 2005

(30) Foreign Application Priority Data

Oct. 8, 2003 (JP) ..... 2003-349203

(51) Int. Cl.
*H01J 49/40* (2006.01)

(52) U.S. Cl. ..... 250/287; 250/282; 250/288

(58) Field of Classification Search ..... 250/287
See application file for complete search history.

(56) References Cited

U.S. PATENT DOCUMENTS 6,037,586 A * 3/2000 Baril ..... 250/287
6,576,895 B1 * 6/2003 Park ..... 250/287

FOREIGN PATENT DOCUMENTS

JP 11-135061 5/1999
JP 11-297267 10/1999

* cited by examiner

*Primary Examiner*—Nikita Wells
*Assistant Examiner*—James J. Leybourne
(74) *Attorney, Agent, or Firm*—Westerman, Hattori, Daniels & Adrian, LLP.

(57) ABSTRACT

In an analysis using a mass spectrometer having a loop orbit along which ions are made to fly a plurality of times, the present invention provides a method of determining the mass-to-charge ratio of an ion without limiting the range of the mass-to-charge ratio of the ions to be brought into the loop orbit while allowing the lapping of the orbiting ions. The measurement is carried out two or more times under different conditions (Tg=500[μs], 400[μs]) under which the number of turns of the ion concerned is different. Flight times are determined from the flight time spectrums obtained by at least two measurements. Though the numbers of turns themselves are unknown, it is possible to calculate possible mass-to-charge ratios for each flight time by incrementally setting the number of turns at plural values. The two sets of possible mass-to-charge ratios derived from the two flight time values (525[μs], 441[μs]) determined by the two measurements are compared with each other, and a value that is found in both measurement results is selected as the mass-to-charge ratio of the ion concerned. Thus, it is possible to determine the mass-to-charge ratio without limiting the range of the mass-to-charge ratio before the ions are brought into the loop orbit.

10 Claims, 3 Drawing Sheets

Fig. 4A

FLIGHT TIME : 525 $\mu$ s

| Nc | m |
|---|---|
| 1 | 20630.6 |
| 2 | 6367.47 |
| 3 | 3051.87 |
| 4 | 1784.66 |
| 5 | 1159.54 |
| 6 | 825.225 |
| 7 | 613.276 |
| 8 | 473.614 |
| 9 | 376.746 |
| 10 | 306.821 |

IDENTICAL

Fig. 4B

FLIGHT TIME : 441 $\mu$ s

| Nc | m |
|---|---|
| 1 | 14557.0 |
| 2 | 4492.89 |
| 3 | 2153.4 |
| 4 | 1259.25 |
| 5 | 825.225 |
| 6 | 582.278 |
| 7 | 432.728 |
| 8 | 334.182 |
| 9 | 265.832 |
| 10 | 216.493 |

Nc: NUMBER OF TURNS
m: MASS TO CHARGE RATIO

Fig. 5

| m | TOF |
|---|---|
| 20630.6 | 525 |
| 6367.47 | 525 |
| 3051.87 | 525 |
| 1784.66 | 525 |
| 1159.54 | 525 |
| 825.225 | 441 |
| 613.276 | 452.59 |
| 473.614 | 461.37 |
| 376.746 | 411.49 |
| 306.821 | 422.561 |

m: MASS TO CHARGE RATIO
TOF: FLIGHT TIME

METHOD OF DETERMINING MASS-TO-CHARGE RATIO OF IONS AND MASS SPECTROMETER USING THE METHOD

The present invention relates to a method of determining the mass-to-charge ratio of ions and, more specifically, to a method of using a mass spectrometer having a flight space in which ions to be analyzed repeatedly fly a loop orbit or a reciprocal path. The present invention also relates to the aforementioned type of mass spectrometer.

BACKGROUND OF THE INVENTION

In a time of flight mass spectrometer (TOF-MS), ions accelerated by an electric field are injected into a flight space where no electric field or magnetic field is present. The ions are separated by their mass-to-charge ratios according to the flight time until they reach and are detected by a detector. Since the difference of the lengths of flight time of two ions having different mass-to-charge ratios is larger as the flight path is longer, it is preferable to design the flight path as long as possible in order to enhance the resolution of the mass-to-charge ratio of a TOF-MS. In many cases, however, it is difficult to incorporate a long straight path in a TOF-MS due to the limited overall size, so that various measures have been taken to effectively lengthen the flight length.

In the Japanese Unexamined Patent Publication No. H11-297267, an elliptical orbit is formed using plural toroidal type sector-formed electric fields, and the ions are guided to fly repeatedly in the elliptical orbit many times, whereby the effective flight length is elongated. In the Japanese Unexamined Patent Publication No. H11-135061, ions fly in an approximately "8" shaped orbit repeatedly. In these TOF-MSs, as the number of turns the ions fly in the orbit increases, the flight distance is larger and the length of flight time is accordingly longer, so that the resolution of the mass-to-charge ratio becomes better by increasing the number of turns.

When, as described above, ions repeatedly fly in a loop orbit, ions having smaller mass-to-charge ratios will gain higher speeds. Therefore, ions having a smaller mass-to-charge ratio may lap other ions having larger mass-to-charge ratios while they are orbiting. If the detector simultaneously detects a group of ions mixed with different number of turns, it is impossible to determine the mass-to-charge ratios of the ions without knowing the number of turns of each ion. One conventional solution to such a problem is to limit the range of the mass-to-charge ratio of the ions brought into the loop orbit in order to avoid ions having such a diversity of mass-to-charge ratios that causes the lapping problem. In this method, if the analysis should cover a broad range of mass-to-charge ratios, it is necessary to divide the range of the mass-to-charge ratio into smaller segments and carry out the analysis many times. If there is only a limited amount of sample available for the analysis, it is difficult to carry out the analysis many times, meaning that the analysis cannot be carried out over the broad range of the mass-to-charge ratio.

To limit the mass-to-charge ratio of the ions before they are brought into the loop orbit, it is necessary to roughly separate the ions by their mass-to-charge ratios before they enter the loop orbit. One possible method is to use an ion trap or other device capable of separating the ions. However, mass spectrometers are not always constructed to allow the use of an ion trap or other ion separator. Another possible method is to make the distance between the ion source and the loop orbit large enough to allow the limitation of the range of mass-to-charge ratios before the ions enter the loop orbit. However, it is not always allowable to keep a large distance between the ion source and the loop orbit because the overall size of the mass spectrometer is limited.

SUMMARY OF THE INVENTION

The main object of the present invention is therefore to provide a method of determining the mass-to-charge ratio of ions whereby the analysis can be carried out over a broad range of mass-to-charge ratios by a far smaller number of measurements. Another object is to provide a method of determining the mass-to-charge ratio of ions that do not require a mechanism for limiting the range of the mass-to-charge ratio of ions before the ions are brought into a loop orbit or reciprocal path in which the ions are made to fly repeatedly. The present invention also provides a mass spectrometer for carrying out the aforementioned method.

In the above-mentioned conventional mass spectrometers, the purpose of limiting the range of the mass-to-charge ratio is to allow only such ions that have flown along the orbit or path the same number of times to reach the detector. This is to avoid the situation where ions having flown along the orbit or path different numbers of times and accordingly having different flight distances reach the detector simultaneously; in this case it is impossible to determine the mass-to-charge ratio because a flight time doesn't provide any information about the number of turns of the ions. However, if it is supposed that the ions have flown along the orbit or path n times (where n is a positive integer), the mass-to-charge ratio can be calculated from the length of the flight time measured. Thus, even if the number of turns n is unknown, it is still possible to sequentially set the value of the number of turns n at 1, 2, 3 and so on, and calculate possible mass to charge ratios for each value of the number of turns.

Even if the number of turns of an ion is unknown, it is possible to vary the number of turns that the ion makes before reaching the detector. For example, an orbiting ion can be controlled to leave the loop orbit at the end of the current turn and fly to the detector after a predetermined period of time from the point of time when the ion leaves the ion source. If the aforementioned period of time is changed, the number of turns that the ion fly the loop orbit may change. Suppose that the length of the flight time of an ion concerned is measured under two different analysis conditions under which the number of turns of the ion concerned is different but the number of turns itself is unknown. For each analysis condition, possible mass-to-charge ratio of the ion can be calculated from the length of the flight time measured, as described above. The difference in the length of flight time between the two measurements should depend on the mass-to-charge ratio of the ion. Therefore, among the possible mass-to-charge ratios derived from the two measurements, if a certain value of the mass-to-charge ratio corresponding to two different numbers of turns is found, the value should be regarded as the mass-to-charge ratio of the ion concerned. In general, the mass-to-charge ratio of an ion can be estimated by measuring the ion under two different analysis conditions under which the number of turns of the ion concerned is different and finding a value of the mass-to-charge ratio that is consistent with the results of the two measurements.

Based on the above-described principle, the present invention provides a method of determining the mass-to-charge ratio of ions with a mass spectrometer having a flight space containing an orbit or path for ions coming from an ion source, a flight controller for making the ions repeatedly fly along the orbit or path a plurality of times, and a detector for detecting the ions after they have flown along the orbit or path a predetermined number of times, and the method includes the steps of:

operating the flight controller to carry out measurements under two or more analysis conditions under which the number of turns of the ions concerned is expected to be different;

processing an output signal of the detector to derive information about two or more flight time spectrums from the measurements; and estimating the mass-to-charge ratio of ions concerned from the information about the flight time spectrums.

The present invention also provides a mass spectrometer, which includes:

a flight space containing an orbit or path for ions coming from an ion source;

a flight controller for making the ions repeatedly fly along the orbit or path a plurality of times;

a detector for detecting the ions after they have flown along the orbit or path a predetermined number of times; and a processor for operating the flight controller to carry out measurements under two or more analysis conditions under which the number of turns of the ions concerned is expected to be different, for processing an output signal of the detector to derive information about a flight time spectrum from at least two measurements, and for estimating the mass-to-charge ratio of the ion from the information about the flight time spectrum.

The orbit or path defined within the flight space may have any form as long as it allows the ions to repeatedly fly along approximately the same orbit or path to have a long flight distance even within a small flight space. For example, it may be a circular, elliptical or "8" shaped loop orbit, or it may be a linear or curved reciprocal path. The ion source used hereby does not need to have a means for generating ions from molecules or atoms; it may be any device that has a means for giving kinetic energy to the ions to inject them into the flight space.

According to the present invention, various kinds of ions coming from the ion source are all brought into the orbit or path; in principle, there is no limitation on the range of the mass-to-charge ratio. Therefore, it is possible that some ions lap other ions while they are repeatedly flying along the orbit or path, so that the peaks located along the flight time axis on the flight time spectrum created from the detection signal of the detector is not always in the order of the mass-to-charge ratio. However, as explained above, it is possible to determine the mass-to-charge ratio of the ions concerned with a high level of probability from flight time spectrums obtained by at least two measurements.

For example, suppose that an ion concerned is measured under two analysis conditions under which the number of turns of the ion concerned is different. Each measurement provides information about a flight time spectrum, and the flight time of the ion concerned is located on each of the two flight time spectrums obtained. As described above, possible mass-to-charge ratios corresponding to different numbers of turns can be calculated from each of the two flight times. Among the possible mass-to-charge ratios calculated from the two flight times of the same kind of ion, there should be a value of the mass-to-charge ratio, or two values of the mass-to-charge ratio that can be approximately regarded as identical, corresponding to two different values of the number of turns. This value is regarded as the mass-to-charge ratio of the ion concerned. The method is not limited to determining a single mass-to-charge ratio, but it can be applied to determining plural mass-to-charge ratios at a time. In the case of simultaneously measuring plural kinds of ions having different mass-to-charge ratios, the mass-to-charge ratio of each kind of ion can be determined by comparing the possible mass-to-charge ratios with each other. However, this idea does not apply for the case where two or more kinds of ions having different numbers of turns occasionally have the same flight time and are inseparable from each other.

The method according to the present invention makes it possible to determine the mass-to-charge ratios of various kinds of ions by carrying out the measurement at least twice. There is no need to limit the range of the mass-to-charge ratio of the ions that are made to repeatedly fly along the loop orbit or reciprocal path. This improves the efficiency of using ions and enables the analysis to cover a broad range of the mass-to-charge ratio even when there is only a small amount of sample available for the analysis. Another advantage is that the time required for the measurement is shortened because the number of measurements necessary for an analysis covering a broad range of the mass-to-charge ratio is less than in the conventional cases. Furthermore, since there is no need to separate the ions by their mass-to-charge ratios before they are brought into the orbit, it is neither necessary to use an ion trap or other ion separator nor increase the distance from the ion source. This prevents the apparatus from having a complex structure or an extraordinary large size.

BRIEF DESCRIPTION OF THE DRAWINGS

FIG. 4A shows the relation between the number of turns and the mass-to-charge ratio for flight time 525[μs], and FIG. 4B shows the same relation for flight time 441[μs].

FIG. 5 shows the flight times for Tg=400[μs], which are mathematically calculated from possible mass-to-charge ratios for Tg=500[μs].

DETAILED DESCRIPTION OF A PREFERRED EMBODIMENT

An embodiment of the mass spectrometer according to the present invention is described, referring to the attached drawings.

Figure 1:
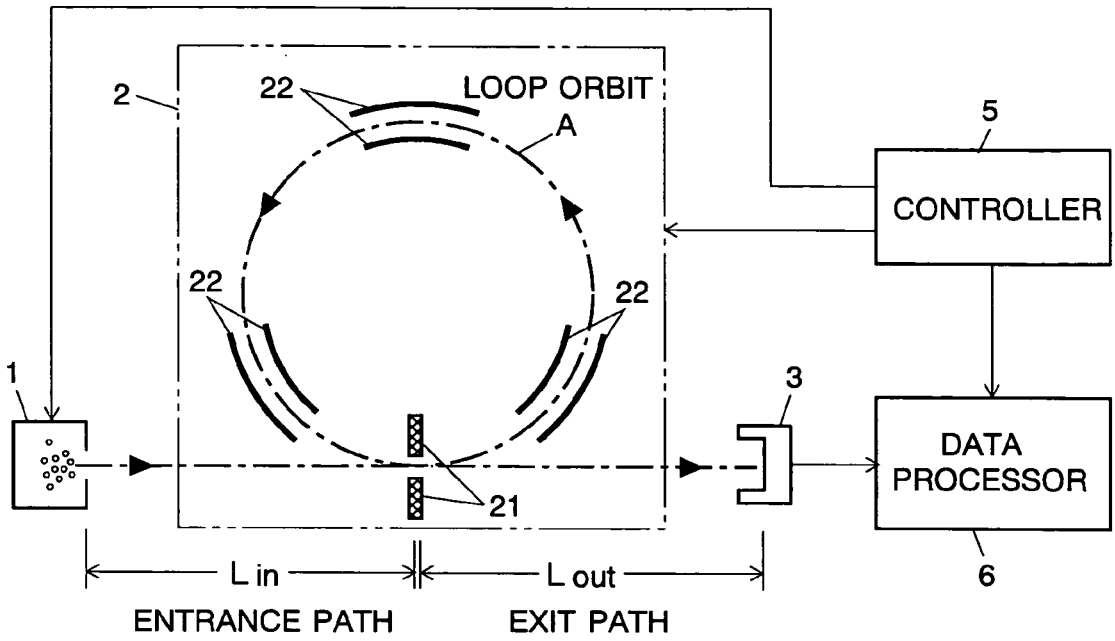
FIG. 1 is a schematic diagram showing the main section of a mass spectrometer as an embodiment of the present invention.

FIG. 1 is a schematic diagram of the mass spectrometer of the present embodiment. In FIG. 1, the ion source 1, the flight space 2 and the ion detector 3 are located inside a vacuum chamber (not shown). The data processor 6 processes the detection signal of the ion detector 3, and the controller 5 controls the flight of the ions and the operation of the data processor 6.

The ion source 1 gives kinetic energy to the ionized molecules, which are the target of the analysis, to inject them into the flight space 2. The molecules may be ionized by any method. When, for example, the mass spectrometer of the present embodiment is used in a gas chromatograph/mass spectrometer (GC/MS), the ion source 1 is constructed to ionize gas molecules by electron impact ionization or chemical ionization. When the mass spectrometer of the present embodiment is used in a liquid chromatograph/mass spectrometer (LC/MS), the ion source 1 is constructed to ionize liquid molecules by atmospheric chemical ionization or electrospray ionization. A method called MALDI (Matrix Assisted Laser Desorption Ionization) is suitable for the analysis of a protein or similar high-molecular compound.

The flight space 2 contains guide electrodes 22 for making ions fly in an approximately circular orbit A and gate electrodes 21 for bringing ions injected into the flight space into the loop orbit A or deflecting the ions from the loop orbit A. In the present embodiment, the loop orbit A is circular, which may otherwise be an elliptical orbit, an "8" shaped orbit or any other loop orbit. It is also allowable to use a linear or curved reciprocal path instead of a loop orbit.

The ion detector 3 is, for example, a photomultiplier, which generates a signal (ion intensity signal) corresponding to the number or amount of ions received. The signal is sent to the data processor 6, which is, for example, constructed by running a predetermined computer program on a personal computer. Receiving the ion intensity signal, the data processor 6 creates a mass spectrum with the mass-to-charge ratio as the abscissa and the ion intensity as the ordinate, and carries out the qualitative analysis and the quantitative analysis based on the mass spectrum. The controller 5 controls the ion source 1 and the electrodes 21 and 22 in the flight space 2 to conduct the mass analysis.

The basic steps of the analysis carried out by the present mass spectrometer are as follows. The controller 5 controls the ion source 1 to give kinetic energy to the ions to be analyzed. This makes the ions leave the ion source 1 and start flying. After leaving the ion source 1, the ions enter the flight space 2 and reach the gate electrodes 21, which bring the ions into the loop orbit A, and the guide electrodes 22 to keep the ions flying along the loop orbit A. After a predetermined period of time from the start of the ions from the ion source 1, the controller 5 changes the voltage applied to the gate electrodes 21 to deflect the ions from the loop orbit A. After that, the ions flying along the loop orbit A are redirected to the detector 3 when passing through the gate electrodes 21. In the detector 3, the incident ions generate a current whose intensity corresponds to the number of the ions detected. This current is sent to the data processor 6 as the ion intensity signal. Since the speed of each ion depends on its mass-to-charge ratio, the ions are separated into groups with respect to their mass-to-charge ratios while they fly along the path extending from the ion source 1 to the ion detector 3, i.e. entrance path+loop orbit A+exit path, and each group of ions reaches the ion detector 3 at a different point in time. The variation of the ion intensity signal with time is recorded to create a flight time spectrum.

The mass spectrometer of the present embodiment is characterized by its method of calculating the mass-to-charge ratio. In FIG. 1, the meanings of the symbols are as follows:

Lin: distance from the ion source 1 to the entrance of the loop orbit A (i.e. length of entrance path)

Lout: distance from the exit of the loop orbit A to the ion detector 3 (i.e. length of the exit path)

U: initial kinetic energy of an ion

Ct(U): length of the flight path along a loop orbit A of an ion having initial kinetic energy m: mass-to-charge ratio of an ion V(m,U): speed of an ion having mass-to-charge ratio m and initial kinetic energy U TOF(m,U): length of flight time of an ion having mass-to-charge ratio m and initial kinetic energy U (i.e. the time required for the ion to fly from the ion source 1 to the ion detector 3)

Lflight(m,U,T): distance covered by an ion having mass-to-charge ratio m and initial kinetic energy U during the period of time T Tg: period of time between the time point when the ions leave the ion source 1 and the time point when the voltage for redirecting the ions from the loop orbit A to the ion detector 3 is applied to the gate electrodes 21

Cl(m,U): position of an ion having mass-to-charge ratio m and initial kinetic energy U on the loop orbit A when Tg has elapsed Nc(m): number of turns that an ion having mass-to-charge ratio m makes along the loop orbit A during the time period Tg It is supposed hereby that an ion leaves the ion source 1 at time point 0 and is brought into the loop orbit A, and the voltage applied to the gate electrodes 21 is changed at time point Tg to redirect the orbiting ion from the loop orbit A to the ion detector 3. The distance covered by the ion until the time point Tg is given by $$L\text{flight}(m,U,Tg)=V(m,U)\times Tg$$

At this time point, the ion orbiting along the loop orbit A is located away from the gate electrodes 21 by the following distance:

$$Cl(m,U)=\{L\text{flight}(m,U,Tg)-L\text{in}\}\bmod Ct(U)$$

i.e. the remainder of {Lflight(m,U,Tg)−Lin} divided by Ct(U). The number of turns of the ion observed during the time period Tg is given by $$Nc(m)=\{L\text{flight}(m,U,Tg)-\text{Lin}-Cl(m,U)\}/Ct(U)$$

The time point TOF(m,U) at which the ion reaches the ion detector 3 is given by $$TOF(m,U)=Tg+\{Ct(U)-Cl(m,U)+\text{Lout}\}/V(m,U)$$

For example, the analysis condition is hereby set as follows:

U=1000[eV]

Lin=Lout=0.16[m]

$Ct(2\text{ keV})=1.28[m]$

Tg=500[μs]

Figure 2:
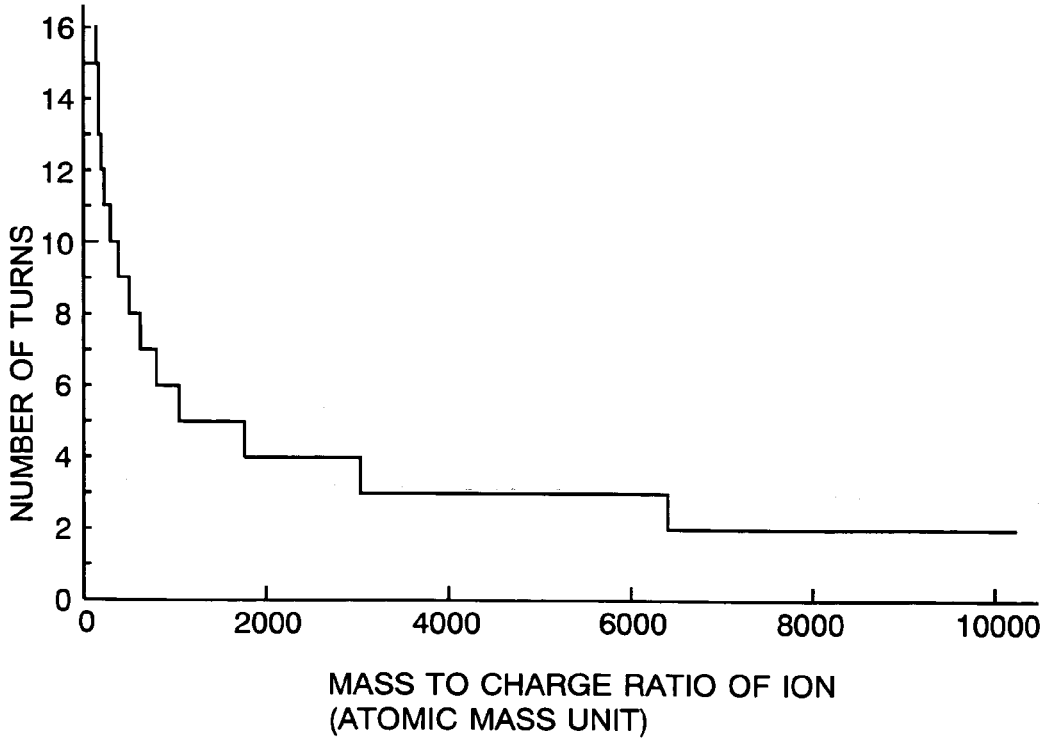
FIG. 2 shows an example of the relation between the number of turns and the mass-to-charge ratio.
Figure 3A:
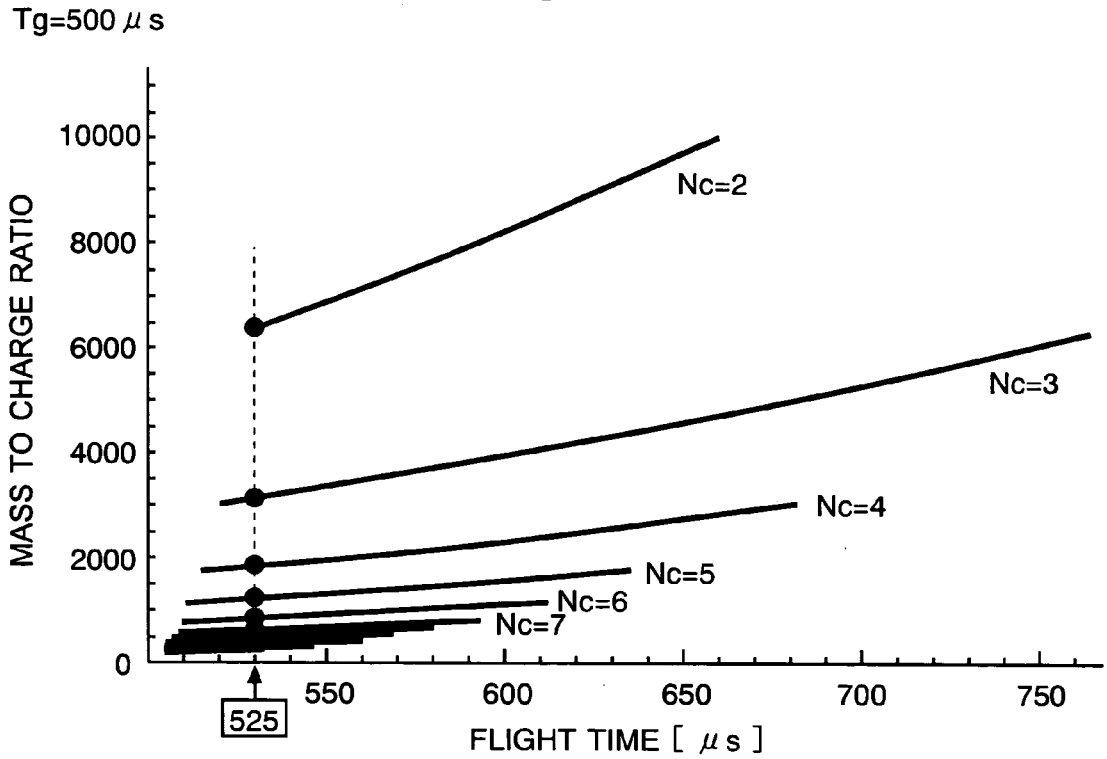
FIGS. 3A and 3B show the relation between the flight time and the mass-to-charge ratio with the number of turns as a parameter.

Under this condition, the relation between the mass-to-charge ratio m of and the number of turns Nc is as shown in FIG. 2, and the relation between the mass-to-charge ratio m and the flight time TOF with the number of turns Nc as a parameter is as shown in FIG. 3A. This figure clearly shows that, for a given flight time, it is possible to identify plural kinds of ions each having a different number of turns (i.e. different mass-to-charge ratio). This means that plural kinds of ions differing in mass-to-charge ratio may reach the ion detector 3 almost-simultaneously after lapping the loop orbit A different number of times (which depend on the kind of the ion). Therefore, it is impossible to determine the mass-to-charge ratio m even when the flight time is measured. For example, suppose that the flight time spectrum has a peak located at flight time 525[μs]. In this case, there are plural values possible for the mass-to-charge ratio, as indicated by the points lying on the dotted line in FIG. 3A. The possible mass-to-charge ratios for flight time 525[μs] corresponding to the number of turns can be listed as shown in FIG. 4A. For simplicity of explanation, the upper limit of the mass-to-charge ratio is set at 10000 and the number of turns is limited to the range from 2 to 10.

Figure 3B:
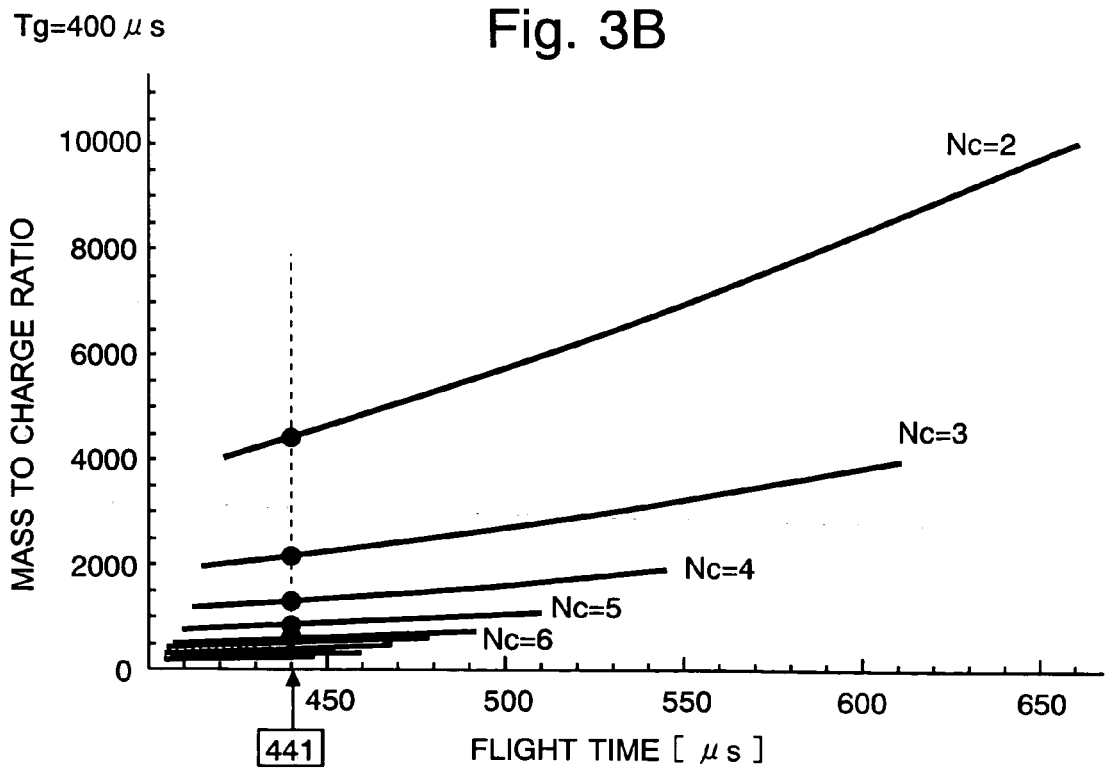

Next, another flight time spectrum is created by carrying out the same measurement with Tg=400[μs]. Under this condition, the ion concerned flies along the loop orbit A a smaller number of times before being redirected to the ion detector 3. FIG. 3B shows the relation between the flight time TOF and the mass-to-charge ratio m with the number of turns Nc as a parameter. Now, suppose that the flight time spectrum has a peak located at flight time 441[μs]. In this case, there are plural values possible for the mass-to-charge ratio, as indicated by the points lying on the dotted line in FIG. 3B. The possible mass-to-charge ratios for flight time 441[μs] corresponding to the number of turns can be listed as shown in FIG. 4B.

Comparing FIG. 4A and FIG. 4B, it is shown that the mass-to-charge ratio corresponding to the number of turns 6 for Tg=500[μs], 825.225, is equal to that corresponding to the number of turns 5 for Tg=400[μs], and there is no other combination of the same mass-to-charge ratio. From this result, the mass-to-charge ratio of the ions concerned can be estimated as 825.225. Thus, even when the number of turn itself is unknown, it is possible to determine the mass-to-charge ratio from the results of the two measurements by changing Tg to vary the number of turns.

It is possible to use another calculation method on the basis of the same principle. In this method, the flight time for Tg=400[μs] is simply calculated from the possible mass-to-charge ratios for Tg=500[μs] shown in FIG. 4A. The result of the calculation is shown in FIG. 5. According to the aforementioned assumption, the actual flight time for Tg=400[μs] is 441[μs]. In FIG. 5, the value of 441[μs] corresponds to the mass-to-charge ratio of 825.225. Thus, it is possible to determine that the mass-to-charge ratio of the ions concerned is 825.225.

The above description assumed that there was only one kind of ion concerned. It should be noted that the mass-to-charge ratio of more than one kind of ion can be simultaneously determined. In this case, the flight time spectrum has plural peaks. For each peak, possible mass-to-charge ratios are calculated from the flight time at which the peak is located. The mass-to-charge ratio of each kind of ion can be determined by carrying out the measurement twice and identifying a possible mass-to-charge ratio that is found in both measurement results. Mass-to-charge ratios can be determined more easily by carrying out the measurement more than twice under different conditions under which the number of turns of each kind of ion concerned is expected to be different. It should be understood, however, that the number of turns might be the same in some cases.

In the case the elements composing the sample to be analyzed are known, it is possible to consider the combination of the elements in the estimation of the mass-to-charge ratio. The estimated mass-to-charge ratios take discrete values. Using these values, it is possible to greatly improve the accuracy of estimating the mass-to-charge ratio by finding a value that is present in both the possible mass-to-charge ratios derived from the flight time as described above and the discrete values. If some information is available for roughly estimating the mass-to-charge ratio of the ions concerned, it is possible to reduce the number of possible mass-to-charge ratios by using the information.

The above embodiment is a mere example of the present invention. It should be understood that any change, modification or addition other than the above-described ones may be made within the sprit and scope of the present invention.

What is claimed is:

1. A method of determining a mass-to-charge ratio of an ion with a mass spectrometer having a flight space containing an orbit or path for ions coming from an ion source, a flight controller for making the ions repeatedly fly along the orbit or path a plurality of times, and a detector for detecting the ions after they have flown along the orbit or path a predetermined number of times, the method comprising steps of:

operating the flight controller to carry out measurements under two or more analysis conditions under which the number of turns of the ion concerned is expected to be different;

processing an output signal of the detector to obtain a flight time spectrum from each of the measurements; and estimating the mass-to-charge ratio of ion concerned from the flight time spectrums.

2. The method according to claim 1, wherein the step of estimating the mass-to-charge ratio includes the steps of: determining a flight time of the ion concerned on each of the flight spectrums; calculating possible mass-to-charge ratios corresponding to different numbers of turns from each flight time; and finding a value of the mass-to-charge ratio, or two values of the mass-to-charge ratio that can be approximately regarded as identical, corresponding to different values of the number of turns.

3. The method according to claim 1, wherein the measurements are carried out under more than two analysis conditions under which the number of turns of each kind of ion concerned is expected to be different.

4. The method according to claim 2, wherein the measurements are carried out under more than two analysis conditions under which the number of turns of each kind of ion concerned is expected to be different.

5. A mass spectrometer, comprising:

a flight space containing an orbit or path for ions coming from an ion source;

a flight controller for making the ions repeatedly fly along the orbit or path a plurality of times;

a detector for detecting the ions after they have flown along the orbit or path a predetermined number of times; and a processor for operating the flight controller to carry out measurements under two or more analysis conditions under which the number of turns of an ion concerned is expected be different, for processing an output signal of the detector to obtain a flight time spectrum from each of the measurements, and for estimating the mass-to-charge ratio of the ion from the flight time spectrums.

6. The mass spectrometer according to claim 5, wherein the processor estimates the mass-to-charge ratio of the ion concerned by determining a flight time of the ion concerned on each of the flight spectrums, calculating possible mass-to-charge ratios corresponding to different numbers of turns from each flight time, and finding a value of the mass-to-charge ratio, or two values of the mass-to-charge ratio that can be approximately regarded as identical, corresponding to different values of the number of turns.

7. The mass spectrometer according to claim 5, wherein the orbit is a circular orbit defined by guide electrodes for making ions fly in the orbit and gate electrodes for bringing ions injected into the flight space into the orbit or deflecting the ions from the orbit.

8. The mass spectrometer according to claim 7, wherein the processor provides the two or more analysis conditions by changing a period of time between a time point when the ions leave the ion source and a time point when a voltage for redirecting the ions from the orbit to the detector is applied to the gate electrodes.

9. The mass spectrometer according to claim 6, wherein the orbit is a circular orbit defined by guide electrodes for making ions fly in the orbit and gate electrodes for bringing ions injected into the flight space into the orbit or deflecting the ions from the orbit.

10. The mass spectrometer according to claim 9, wherein the processor provides the two or more analysis conditions by changing a period of time between a time point when the ions leave the ion source and a time point when a voltage for redirecting the ions from the orbit to the detector is applied to the gate electrodes.

* * * * *